US005992508A

United States Patent [19]

Lowenstein et al.

[11] Patent Number: 5,992,508

[45] Date of Patent: Nov. 30, 1999

[54] THIN PLASTIC-FILM HEAT EXCHANGER FOR ABSORPTION CHILLERS

[75] Inventors: Andrew I. Lowenstein, Princeton; Marc J. Sibilia, Blawenburg, both of N.J.

[73] Assignee: Gas Research Institute, Chicago, Ill.

[21] Appl. No.: 08/718,037

[22] Filed: Sep. 23, 1996

Related U.S. Application Data

[63] Continuation of application No. 08/303,476, Sep. 9, 1994, abandoned.

[51] Int. Cl.[6] ..... F28F 7/00

[52] U.S. Cl. ..... 165/46; 165/905

[58] Field of Search ..... 165/46, 905

[56] References Cited

U.S. PATENT DOCUMENTS

| | | | |
|---|---|---|---|
| 3,612,059 | 10/1971 | Ersek | 165/46 X |
| 3,736,769 | 6/1973 | Petersen | 165/46 X |
| 3,771,320 | 11/1973 | Kenneryd et al. | 62/239 |
| 4,006,604 | 2/1977 | Seff | 62/261 |
| 4,030,541 | 6/1977 | Gross et al. | 165/175 |
| 4,118,946 | 10/1978 | Tubin | 62/514 R |
| 4,152,904 | 5/1979 | Hester | 62/475 |
| 4,230,175 | 10/1980 | Disselbeck et al. | 165/46 |
| 4,393,923 | 7/1983 | Press | 165/46 |
| 4,483,321 | 11/1984 | Sharpe | 126/426 |
| 4,693,302 | 9/1987 | Dodds | 165/46 |
| 4,933,046 | 6/1990 | May | 202/185.3 |
| 5,086,771 | 2/1992 | Molloy | 165/46 X |
| B1 4,230,175 | 5/1986 | Disselbeck et al. | 165/46 |

*Primary Examiner*—John Fox
*Attorney, Agent, or Firm*—Dick and Harris

[57] ABSTRACT

A thin plastic-film heat exchanger element for apparatus, such as absorption chillers, is provided, having improved strengthening in the turning regions of the fluid passages, for enhanced resistance to bursting. A method of manufacture, for reduced wrinkling or pleating in the turning regions, is also disclosed.

8 Claims, 3 Drawing Sheets

THIN PLASTIC-FILM HEAT EXCHANGER FOR ABSORPTION CHILLERS

This is a file wrapper continuing application of application Ser. No. 08/303,476, filed Sep. 9, 1994, now hereby abandoned.

BACKGROUND OF THE INVENTION

1. Field of the Invention

The present invention is directed to heat exchanger elements of the type formed by two layers of thin-film plastic material, in which flow passages are formed by the advantageous placement of seams or welds between the two layers, for example, by heat sealing or ultrasonic welding, to produce a serpentine passage through the heat exchanger element. The present invention is further directed to such heat exchanger elements, as may be employed in the field of absorption heat pump apparatus.

2. Prior Art

Gas-fired absorption heat pump apparatus, particularly absorption chillers, in order to have high enough coefficients of performance, in order to be efficient and competitive with presently used, more conventional cooling apparatus, require the use of large area heat exchanger elements, in the absorber and evaporator sections of the heat pump systems. However, with increased size, comes increased weight and cost. Accordingly, alternatives to metal-construction heat exchanger elements are being sought.

One alternative which is being explored, is the use of plastic film heat exchanger elements, in which each of the one or more elements is composed of two sheets of thin plastic film, which are bound or welded to one another, with serpentine passages formed between the sheets by a plurality of seams or welds formed by thermal or ultrasonic welds.

Such heat exchanger elements typically will be situated in a working environment of less than atmospheric pressure, in a vacuum vessel and during operation, are exposed to a continuous partial vacuum. Accordingly, the material from which the heat exchanger element is constructed must be resistant to creep, particularly since such heat exchanger elements are intended to be long lifespan components (10–20 years).

An additional consideration is that the plastic material must be resistant to the migration through the material of non-condensable gases, which may be entrained in the fluid (typically water, or a water-based solution). If such gases escape through the heat exchanger walls into the vacuum vessel, then the efficiency of the absorber/evaporator is diminished. Currently known metallic heat exchanger element based systems have scheduled purges of such gases from their vacuum vessels at regular intervals. Accordingly, it would be desirable to construct a plastic film heat exchanger element which has a low enough permeability such that purges would not be required more often than with conventionally known systems.

A plastic-film heat exchanger element is disclosed in May, U.S. Pat. No. 4,933,046, in which the heat exchanger element is used as the condenser for a water purifying system. The heat exchanger element has passageways, formed by thermal welds, which are substantially rectangular in plan, and generally circular in cross-section, with cross-sectional areas which decrease, proceeding from an upper (steam) portion to a lower (condensate) portion.

Tubin, U.S. Pat. No. 4,118,946, discloses a personnel cooler, featuring a plastic film heat exchanger element configured as a vest, in which cooling fluids are disposed.

Dodds, U.S. Pat. No. 4,693,302, discloses a thin plastic sheet heat exchanger element having serpentine fluid passages formed by curvilinear patterns of welds. One embodiment is made of two films of equal thickness, resulting in fluid passages that are substantially round in shape. In another embodiment, sheets of unequal thickness are employed, which yield fluid passages which are flattened on one side.

Plastic film heat exchanger elements cannot operate at the same kinds of pressures that metal-constructed heat exchanger elements can. Accordingly, it is desirable to increase the potential operating pressure of such heat exchanger elements. The bends in the serpentine passageways are generally those portions of the heat exchanger elements which are most vulnerable to failure.

Furthermore, since additional sheet material area is necessary to accommodate the fluid passages, during manufacture, it is difficult to avoid the generation of creases or folds, in the corners of the bends. Such creases create flow inefficiencies, and create sites for fatigue and potential failure, as well.

Accordingly, it would be desirable to provide a plastic film heat exchanger element which would be substantially free of such creases or folds in the corner regions.

DISCLOSURE OF THE INVENTION

The present invention is a heat exchanger apparatus, of the type formed from two sheets of plastic material, and having a plurality of seams therebetween defining two or more liquid-tight passages through the heat exchanger apparatus, with one or more turning regions, each formed by an inner, substantially arcuate seam and an outer, substantially arcuate seam, and wherein the one or more turning regions connect the two or more passages, to define at least one liquid passage through the heat exchanger apparatus to enable a liquid heat-transfer medium to be passed therethrough for transferring heat to or from the liquid heat-transfer medium from or to the ambient surroundings of the heat exchanger apparatus. The apparatus further comprises means for facilitating resistance to bursting of the passages along the seams, from pressure exerted by the liquid heat-transfer medium which is operably disposed along the one or more turning regions.

In a preferred embodiment of the invention, the means for facilitating resistance to bursting of the passages comprises a thickening of the sheets of plastic material along the one or more turning regions.

In another preferred embodiment of the invention, the two or more liquid-tight passages extend substantially alongside one another and each passage has a predetermined diameter, the two or more liquid-tight passages being laterally separated from one another by a predetermined distance, and the means for facilitating resistance to bursting of said passages comprises the inner, substantially arcuate seam connecting a respective two of the two or more liquid-tight passages having an arc length greater than that of a semicircular arc having a diameter equal to the predetermined spacing between the respective two of the two or more liquid tight passages. Alternatively, the outer, substantially arcuate seam connecting a respective two of the two or more liquid-tight passages has an arc length greater than a semicircular arc having a diameter equal to the sum of the predetermined spacing between the respective two or more liquid-tight passages and the predetermined diameters of the respective two of the two or more liquid-tight passages.

In still another preferred embodiment, the inner, substantially arcuate seam connecting a respective two of the two or more liquid-tight passages has an arc length greater than that of a semicircular arc having a diameter equal to the predetermined spacing between the respective two of the two or more liquid tight passages; and the outer, substantially arcuate seam connecting a respective two of the two or more liquid-tight passages has an arc length greater than a semicircular arc having a diameter equal to the sum of the predetermined spacing between the respective two or more liquid-tight passages and the predetermined diameters of the respective two of the two or more liquid-tight passages.

In one preferred embodiment of the invention, at least one of the sheets of plastic film material may be fabricated from one of the following materials: PET (sold under the name Mylar), PEEK, polysulphone, nylon 6, the material sold under the name Celcon, the material sold under the name Tedlar (polyvinyl fluoride), the material sold under the name Tefzel (ETFE) polyethylene, polypropylene, polystyrene and PVC. In another embodiment of the invention, at least one of the sheets of plastic material is a laminate of two or more layers of different plastic materials which may have the following layer structure: Mylar/PVDC/adhesive/polyethylene-EVA.

The invention also comprises a method for forming a heat exchanger apparatus of the type comprising two sheets of plastic material bonded together by a plurality of seams, and having two or more liquid-tight passages therein connected by one or more turning regions, each such turning region having an inner, substantially arcuate seam and an outer, substantially arcuate seam, to define at least one liquid passage path through the heat exchanger to enable a liquid heat-transfer medium to be passed therethrough for transferring heat to or from the liquid heat-transfer medium from or to the ambient surroundings of the heat exchanger apparatus. In particular, the method comprises the steps of: providing two sheets of plastic material; determining at least one desired liquid passage path to be defined in the heat exchanger apparatus; bonding the two sheets of plastic material to one another with a plurality of substantially continuous seams therebetween to form two or more liquid-tight passages through the heat exchanger apparatus, with one or more turning regions, each formed by an inner, substantially arcuate seam and an outer, substantially arcuate seam, the one or more turning regions connecting the two or more passages; inflating the heat exchanger apparatus by passing liquid through the liquid passage path; immersing a first end of the inflated heat exchanger apparatus into water of sufficiently high temperature to cause said plastic material to become thermoformable, so as to remove creases which may have formed in the one or more turning regions upon inflation of the heat exchanger apparatus; immersing a second, opposite end of the inflated heat exchanger apparatus into water of sufficiently high temperature to cause said plastic material to become thermoformable, so as to remove creases which may have formed in the one or more turning regions upon inflation of the heat exchanger apparatus, so as to provide a heat exchanger apparatus substantially free of creases in the one or more turning regions thereof.

BEST MODE FOR CARRYING-OUT THE INVENTION

Figure 1:
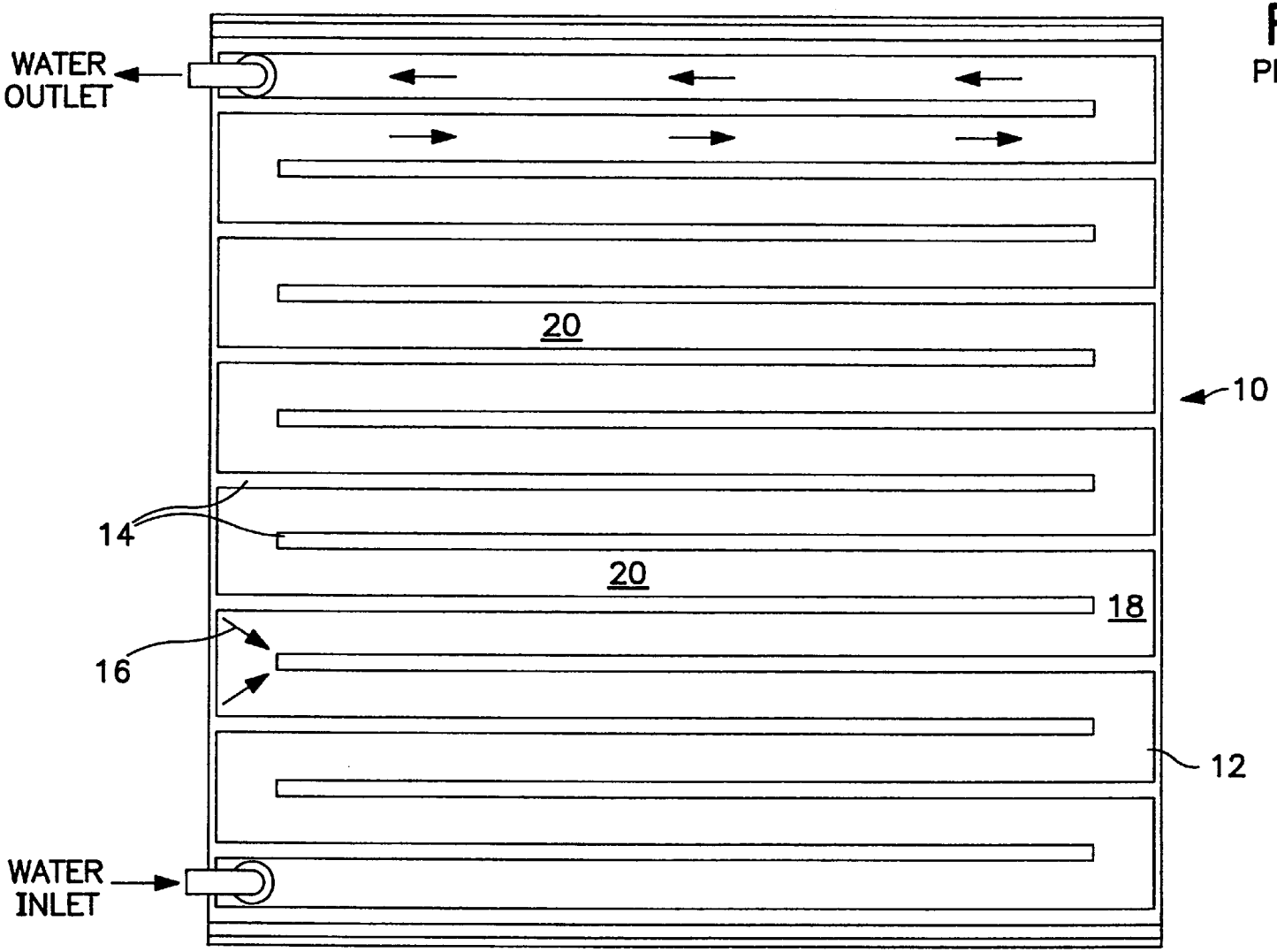
FIG. 1 PRIOR ART
FIG. 1 is a prior art heat exchanger element.

While the present invention is susceptible of embodiment in many different forms, there is shown in the drawings and will be described herein in detail, a single preferred embodiment, with the understanding that the present disclosure is to be considered as an exemplification of the principles of the invention, and is not intended to limit the invention to the embodiment illustrated.

A prior art plastic film heat exchanger element 10 is illustrated in FIG. 1. Two sheets 12 of thin film plastic material are bonded together by heat or ultrasonic energy, by a plurality of rectilinear seams 14. When heat exchanger element 10 becomes "inflated" by the liquid during use, deep folds 16 may form in the turning regions 18, which may affect the flow of the water through the passages 20 formed by seams 14. The square, "hairpin" nature of the turning regions may also lead to a weaker overall heat exchanger structure, since the seams 14 in the vicinity of the turning regions bear greater stress from the flowing, pressurized water than do the seams forming the passages 20.

Figure 2:
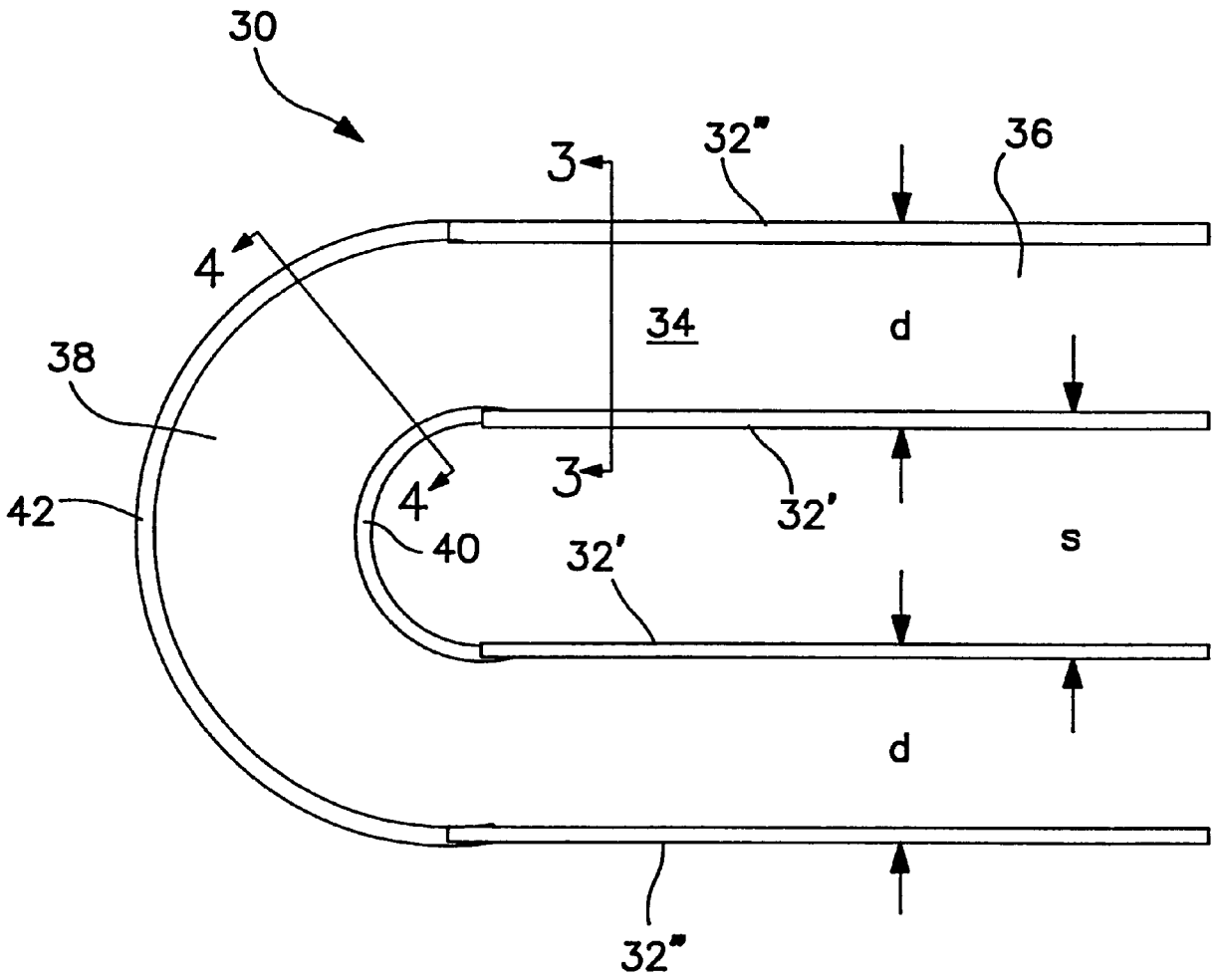
FIG. 2 is a view of one turning region of a heat exchanger element according to the present invention.

A portion of a heat exchanger element 30, according to the present invention is illustrated in FIG. 2. Heat exchanger element 30 would also be formed from two sheets, typically in mirror image to one another. Seams 32' and 32" create the flow passages 34 comprising straight parallel portions 36, and turning regions 38. A typical heat exchanger element 30 will have a plurality of straight runs which are of uniform diameter d and spacing s, and the runs will be substantially parallel to one another. The seams may be formed, except as described hereinafter, by known means of thermally bonding or sealing layers of plastic sheet material.

The anticipated operational environment of heat exchanger element 30 will place considerable performance demands on the materials from which heat exchanger element 30 is made. For example, since heat exchanger element 30 is expected to have a 10–20 year lifespan, the plastic film should be from a material which has a relatively high tensile strength, and high creep resistance so as to reduce the likelihood of deformation, and/or failure through creep of the material.

In order to have an efficient heat transfer surface, the wall thickness of the plastic film should be limited to 6 mils or less, as a general consideration, since plastic materials typically have thermal conductivities which are 3 to 4 orders of magnitude less than metals. In addition, the tensile strength of plastic materials is usually 5 to 50 times less than even "weaker" metals, such as copper or brass.

In conventional metal heat exchanger elements, pressures of 60 pounds per square inch are known. These would be pressures typical of a lower floor absorption chiller for a mid- to high-rise building. Such pressures cannot presently be maintained in efficient plastic film heat exchanger elements, and so such applications cannot be considered reasonable goals for heat exchanger elements such as in the present invention. However, for smaller installations, such as rooftop units for low rise buildings, and advantageous fluid circuiting, absolute pressures for absorbers and evaporators can reasonably be kept in the range of 30 psi.

As discussed elsewhere herein, unless non-aerated water is employed in the cooling system, there will be certain amounts of oxygen and nitrogen dissolved into the water, which, due to the pressure differential across the heat exchanger element film, will tend to be driven from the water and through the film. Such gases must then be purged occasionally from the vacuum vessel for efficient operation.

Accordingly, an ideal plastic film would have a high tensile strength, low permeability, high thermal conductivity, and a resistance to creep under stress over time. An additional characteristic is that the plastic should be able to resist attack by the absorbent solution material, at absorber operating temperatures. For example, a typical absorbent solution is lithium bromide.

Candidate materials which have been contemplated are the materials known as PET (sold under the name Mylar), PEEK, polysulphone, nylon 6, the material sold under the name Celcon, the material sold under the name Tedla (polyvinyl fluoride) the material sold under the name Tefzel (ETFE), polyethylene, polypropylene, polystyrene and PVC. All of these materials have high tensile strengths of over 7000 psi. However, a review of available published statistics on such characteristics as permeability (when available), thermal conductivity, heat sealability, etc. reveals that there is no particular correlation between one characteristic and another. However, the aforementioned materials have been identified as having combinations of characteristics which make them candidates for use as single material plastic films.

Figure 5:
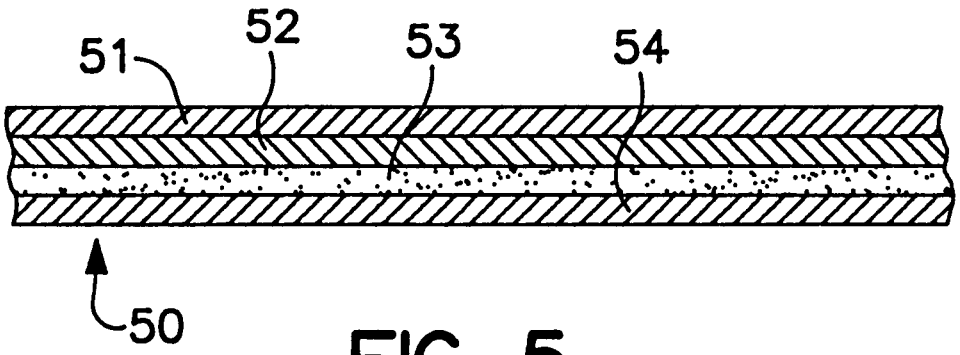
FIG. 5 is a sectional elevation of a sheet of composite material for fabricating an apparatus according to an alternative embodiment.

As an additional possible solution to the need for a versatile material, a composite laminated film is contemplated, which would have, for example, at least an extremely thin high tensile strength layer, and a low permeability layer. A layer having thermal bonding characteristics might also be provided. One possible laminate material is commercially known as PM300S, and is made up of the following layers: Mylar/PVDC/adhesive/polyethylene-EVA. FIG. 5 is a sectional view of a portion of a composite sheet 50, showing the layers of Mylar (51), PVDC (52), adhesive (53) and polyethylene-EVA (54). The material has a film thickness of 2.5 mil, and has an oxygen permeability of 0.49 cubic centimeters per 100 square inches-days-atmospheres. A single 0.325" diameter tube fabricated from this material has an anticipated burst pressure of 60 psi, and a complete exchanger element might possibly have a burst pressure in the range of 20+ psi, since, as is known, the ultimate bursting pressure of a completed heat exchanger element will typically be far less than the experimental or theoretical pressure limit of the material, for example, as formed into a simple single tube, due the inherent susceptibility of the seams in the regions of the turning regions in the completed element.

One method of improving the resistance to bursting in the completed heat exchanger element, is to avoid the use of "hairpin" turning regions. Accordingly, in order to spread the stresses over a greater length of seam, for a given straight run tube diameter d, one or both of the inside seam 40, and outside seam 42 in the turning region 38 may be provided with an arc length greater than that of a semicircular arc having a diameter equal to the spacing between the straight runs, in the case of an inside seam 40, or of the sum of the spacing s and the sum of the diameters d of the two adjacent straight run passages. This may be accomplished by providing that seams 40 and/or 42 have increased radii of curvature, and extend around through greater than 180° in which the outer seam 42 has a diameter which extends wider than the distance between seams 32". By constructing the inside and/or outside seams of the turning regions in this manner, the stress and pressure which is imposed on the turning regions is spread out over a greater arc length, and tends to reduce the likelihood of bursting and seam failure.

Figure 3:
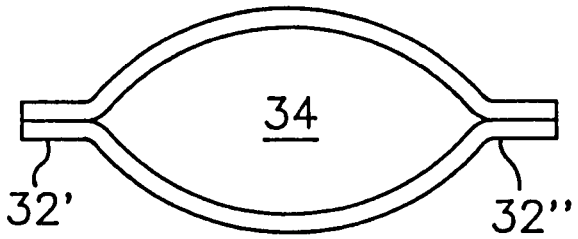
FIG. 3 is a sectional view of the apparatus, as seen along lines 3—3 of FIG. 2.
Figure 4:
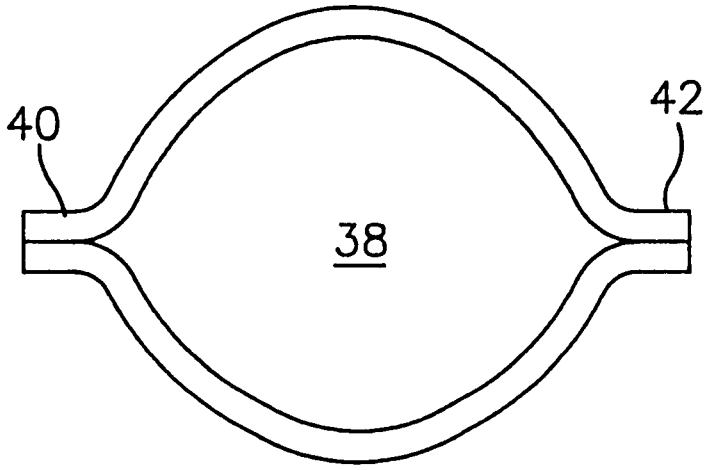
FIG. 4 is a sectional view of the apparatus, as seen along lines 4—4 of FIG. 2.

A further method of reducing the likelihood of failure in the turning regions is to increase the thickness of the plastic sheets, only in the areas of the turning regions. FIG. 3 illustrates a sectional view through straight flow passage 34, while FIG. 4 illustrates a sectional view in turning region 38, showing the increased thickness of the sheet material. However, this solution only is appropriate for heat exchanger elements which are formed from single material, non-laminate sheets. Laminate sheet heat exchangers must rely upon their high-strength layers, and the previously described improved turning region construction for failure resistance.

One potential manufacturing problem which may arise, as previously described, is that upon "inflation" of the heat exchanger element, deep creases or folds form on the turning regions. This is a potential problem particularly for stiffer plastic films, such as a high density polyethylene (HDPE). A method for substantially preventing the formation of these creases is to fabricate the heat exchanger element from the flat film. Then, one end of the element is immersed in hot water (or other non-reactive fluid medium) at a predetermined temperature, while pressurizing the element at a predetermined pressure. Under the action of the pressure and heat, the turning regions in the inflated immersed end becomes thermoformed, and the creases are substantially eliminated. After cooling of the thermoformed end, this procedure is repeated for the other end of the heat exchanger element, to provide a heat exchanger element which is substantially free of creases or folds in the turning regions, during operation.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

We claim:

1. A heat exchanger apparatus comprising:

two sheets of plastic material having a plurality of substantially straight passage seams therebetween defining two or more substantially straight liquid passages through the heat exchanger apparatus, and further defining one or more turning regions, each turning region being formed by an inner, substantially arcuate turning region seam and an outer, substantially arcuate turning region seam, the one or more turning regions connecting the two or more passages, in a substantially continuous manner, to define at least one substantially continuous, non-branching liquid conduit through the heat exchanger apparatus, each such at least one substantially continuous, non-branching liquid conduit having an inlet for permitting entry of liquid heat-transfer medium into the heat exchanger apparatus, and an outlet for permitting the liquid-heat transfer medium to exit the heat exchanger apparatus, the liquid conduit proceeding in a substantially continuous, non-branching manner from the inlet to the outlet, to enable a liquid heat-transfer medium to be passed therethrough for transferring heat to or from the liquid heat-transfer medium from or to the ambient surroundings of the heat exchanger apparatus; and means for facilitating resistance to bursting of said apparatus along the turning region seams, from pressure exerted by the liquid heat-transfer medium, operably disposed along the one or more turning regions.

2. The heat exchanger apparatus according to claim 1 wherein the means for facilitating resistance to bursting of said passages comprises:

a thickening of the sheets of plastic material along the one or more turning regions.

3. The heat exchanger apparatus according to claim 1 wherein the two or more liquid passages extend substantially alongside one another and each passage has a predetermined diameter, the two or more liquid passages being laterally separated from one another by a predetermined distance, the means for facilitating resistance to bursting of said passages comprises the inner, substantially arcuate seam connecting a respective two of the two or more liquid passages having an arc length greater than that of a semicircular arc having a diameter equal to the predetermined spacing between the respective two of the two or more liquid passages.

4. The heat exchanger apparatus according to claim 1 wherein the two or more liquid passages extend substantially alongside one another and each passage has a predetermined diameter, and, the two or more liquid passages being laterally separated from one another by a predetermined distance, the means for facilitating resistance to bursting of said passages comprises the outer, substantially arcuate seam connecting a respective two of the two or more liquid passages having an arc length greater than a semicircular arc having a diameter equal to the sum of the predetermined spacing between the respective two or more liquid passages and the predetermined diameters of the respective two of the two or more liquid passages.

5. The heat exchanger apparatus according to claim 1 wherein the two or more liquid passages extend substantially alongside one another and each passage has a predetermined diameter, and the two or more liquid passages being laterally separated from one another by a predetermined distance, the means for facilitating resistance to bursting of said passages comprises the inner, substantially arcuate seam connecting a respective two of the two or more liquid passages having an arc length greater than that of a semicircular arc having a diameter equal to the predetermined spacing between the respective two of the two or more liquid passages; and the outer, substantially arcuate seam connecting a respective two of the two or more liquid passages having an arc length greater than a semicircular arc having a diameter equal to the sum of the predetermined spacing between the respective two or more liquid passages and the predetermined diameters of the respective two of the two or more liquid passages.

6. The heat exchanger apparatus according to claim 1 wherein at least one of the sheets of plastic film material is selected from the group comprising PET (sold under the name Mylar), PEEK, polysulphone, nylon 6, Celcon, Tedlar (polyvinyl fluoride) Tefzel (ETFE), polyethylene, polypropylene, polystyrene and PVC.

7. The heat exchanger apparatus according to claim 1 wherein at least one of the sheets of plastic material is a laminate of two or more layers of different plastic materials.

8. A heat exchanger apparatus comprising:

two sheets of plastic material having a plurality of passage seams therebetween defining two or more liquid passages through the heat exchanger apparatus, and further defining one or more turning regions, each turning region being formed by an inner, substantially arcuate turning region seam and an outer, substantially arcuate turning region seam, the one or more turning regions connecting the two or more passages, to define at least one liquid conduit through the heat exchanger apparatus to enable a liquid heat-transfer medium to be passed therethrough for transferring heat to or from the liquid heat-transfer medium from or to the ambient surroundings of the heat exchanger apparatus; and means for facilitating resistance to bursting of said apparatus along the turning region seams, from pressure exerted by the liquid heat-transfer medium, operably disposed along the one or more turning regions, the at least one of the sheets of plastic material being a laminate of two or more layers of different plastic materials, the laminate of two or more layers of different plastic materials having the following layer structure:

Mylar/PVDC/adhesive/polyethylene-EVA.

* * * * *